US007293482B1

(12) United States Patent
Wolf et al.

(10) Patent No.: US 7,293,482 B1
(45) Date of Patent: Nov. 13, 2007

(54) WING NUT INSTALLATION AND REMOVAL TOOL

(76) Inventors: Edward A. Wolf, 7963 NW. 70th Ave., Parkland, FL (US) 33067; Mark Clark, 19076 Eagles Way Ct., Loxahatchee, FL (US) 33470

( * ) Notice: Subject to any disclaimer, the term of this patent is extended or adjusted under 35 U.S.C. 154(b) by 0 days.

(21) Appl. No.: 11/532,230

(22) Filed: Sep. 15, 2006

Related U.S. Application Data

(63) Continuation-in-part of application No. 11/423,137, filed on Jun. 8, 2006.

(51) Int. Cl.
*B25B 13/00* (2006.01)
*B25B 23/16* (2006.01)
*B25B 13/48* (2006.01)

(52) U.S. Cl. ..... 81/124.2; 81/177.4; 81/176.15

(58) Field of Classification Search ..... 81/124.2, 81/125, 124.6, 64, 436, 442, 451, 490, 177.4, 81/176.1, 176.15; D8/21, 27, 29
See application file for complete search history.

(56) References Cited

U.S. PATENT DOCUMENTS 1,321,776 A * 11/1919 Stepanian ..... 81/124.2
3,086,414 A * 4/1963 Nardi ..... 81/124.2
3,837,244 A * 9/1974 Schera, Jr. ..... 81/64
4,685,360 A 8/1987 McCurdy
4,823,650 A 4/1989 Tuttle
4,846,042 A * 7/1989 Wetty ..... 81/490
D329,178 S * 9/1992 Ackerman ..... D8/21
5,697,268 A 12/1997 Makovsky et al.
D403,934 S * 1/1999 Girdler et al. ..... D8/27
6,019,019 A 2/2000 Hobbs
6,314,841 B1 * 11/2001 Burk et al. ..... 81/124.2
6,968,758 B2 11/2005 Lin
7,069,820 B2 * 7/2006 Goacher, Sr. ..... 81/124.2
2004/0255727 A1 * 12/2004 Kovach ..... 81/176.15

* cited by examiner

*Primary Examiner*—Hadi Shakeri
(74) *Attorney, Agent, or Firm*—Malin, Haley & DiMaggio, P.A.

(57) ABSTRACT

A tool for installing and removing wing nuts. The tool includes an ergonomic, rigid handle for gripping by the hand of the user. One end of the handle includes wing nut engagement features that center the wing nut for a snug engagement by the tool. The tool is manually rotated to either tighten or loosen wing nuts. The tool is particularly useful for the installation and removal of wing nuts used to secure storm panels over the windows and doors of a building structure.

14 Claims, 6 Drawing Sheets

WING NUT INSTALLATION AND REMOVAL TOOL

BACKGROUND OF THE INVENTION

1. Field of the Invention

In the preferred embodiment, the invention relates to a tool for tightening and loosening wing nuts that are commonly used to secure hurricane storm panels.

2. Description of Related Art

Wing nuts are ubiquitous in locations prone to experience hurricanes and other severe tropical weather systems where they are used to attach many types of storm shutters and panels over windows and doors of homes, businesses, and other structures. The prior art contains several awkward wing nut adapters for use with electric tools, however, no lightweight, ergonomic wing nut installation and removal tools are described. These devices do not securely engage the wing nut and can allow the wing nut to become dislodged or to slip during tightening and loosening.

U.S. Pat. No. 6,968,758, issued to Lin on Nov. 29, 2005, describes a wrench adaptor for driving screw driver bits. By itself, the Lin invention may not be used as a tool for turning wing nuts.

U.S. Pat. No. 6,019,019, issued to Hobbs on Feb. 1, 2000, describes a clearance extension for wrenches. Like Lin, by itself, the Hobbs invention cannot be used as a tool for turning wing nuts.

U.S. Pat. No. 5,697,268, issued to Makovsky et al., on Dec. 16, 1997, describes a wing nut driver. The Makovsky invention is designed to be connected to and used with a driving tool, and may not be used alone as a tool for turning wing nuts.

U.S. Pat. No. 4,823,650, issued to Tuttle on Apr. 25, 1989, describes a power-driven wire nut wrench that is used to fasten and secure helical spring wire connectors. The Tuttle invention includes a shaft that is placed into and engaged by a chuck of a power tool. The Tuttle invention may not be used alone as a tool for turning wing nuts.

U.S. Pat. No. 4,685,360, issued to McCurdy on Aug. 11, 1987, describes a drawing holder nut wrench comprising a flat plate having one or more bends and an opening shaped as a wing nut. The McCurdy invention does not include the centering and frictional gripping components of the invention described herein.

SUMMARY OF THE INVENTION

The apparatus is a wing nut installation and removal tool for tightening and loosening wing nuts, such as those used to secure storm shutter panels over windows and doors in areas prone to receive hurricanes and other tropical weather systems. The tool includes a rigid handle body and a wing nut engagement surface. The handle body is preferably hollow and may include a cap on one end to secure objects inside the hollow space defined by the walls of said handle body. The handle body may also include an adapter, such as a chuck or shank, to connect the tool to an electric driving tool.

The wing nut engagement surface is preferably circular in shape and includes one or more slots cut into the surface which radiate from and pass through a central aperture. The stud portion of the wing nut passes freely into the aperture and hollow space of the rigid handle body. The slots of the wing nut engagement surface accommodate and secure the wings of the wing nut during rotation of the tool by the user.

An object of the invention is to provide a manual tool for installing and removing wing nuts.

Another object of the invention is to provide a manual tool for the installation and removal of wing nuts that includes an adapter permitting said tool to be connected to an electric tool.

In accordance with these and other objects which will become apparent hereinafter, the instant invention will now be described with particular reference to the accompanying drawings.

DETAILED DESCRIPTION

Figure 1B:
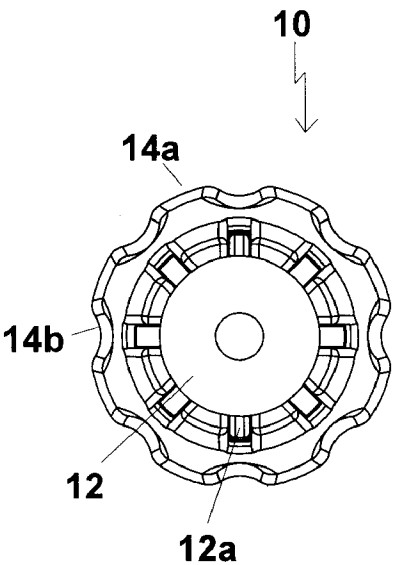
FIG. 1B shows a front elevational view of the tool engaging a wing nut.
Figure 1A:
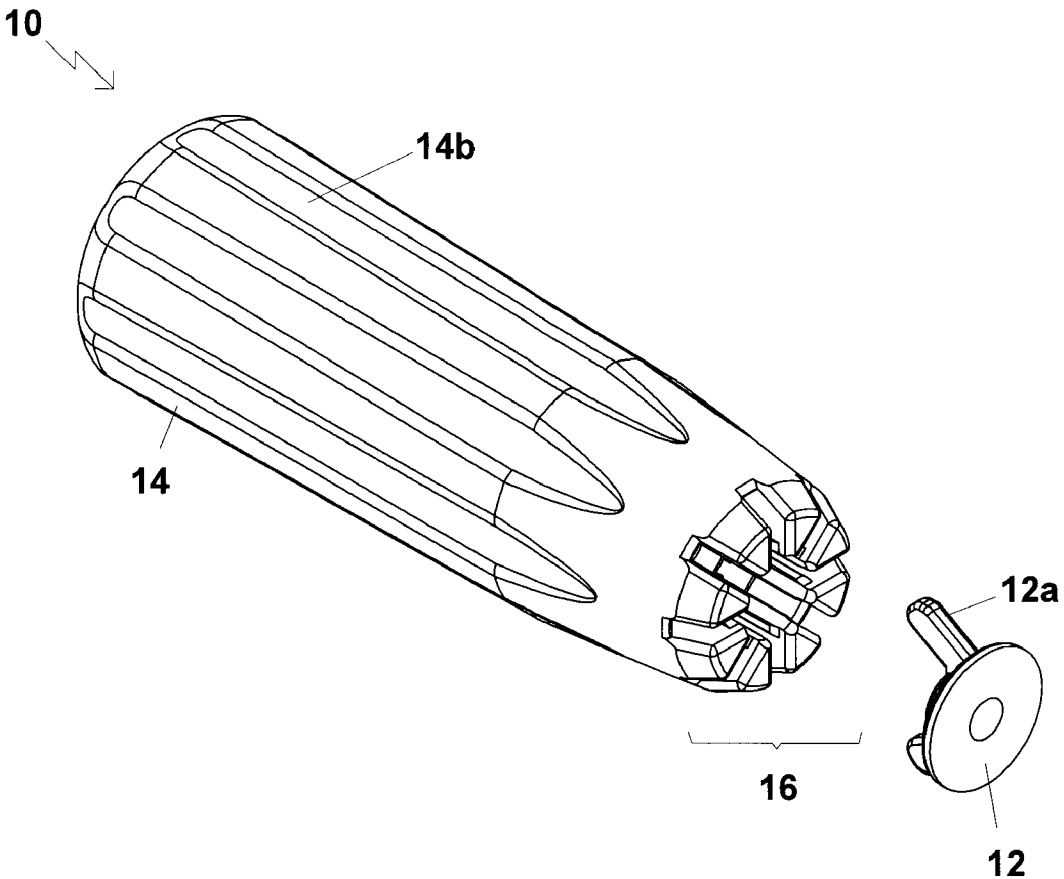
FIG. 1A shows a perspective view of the tool aligned with a wing nut.
Figures 5, 6:
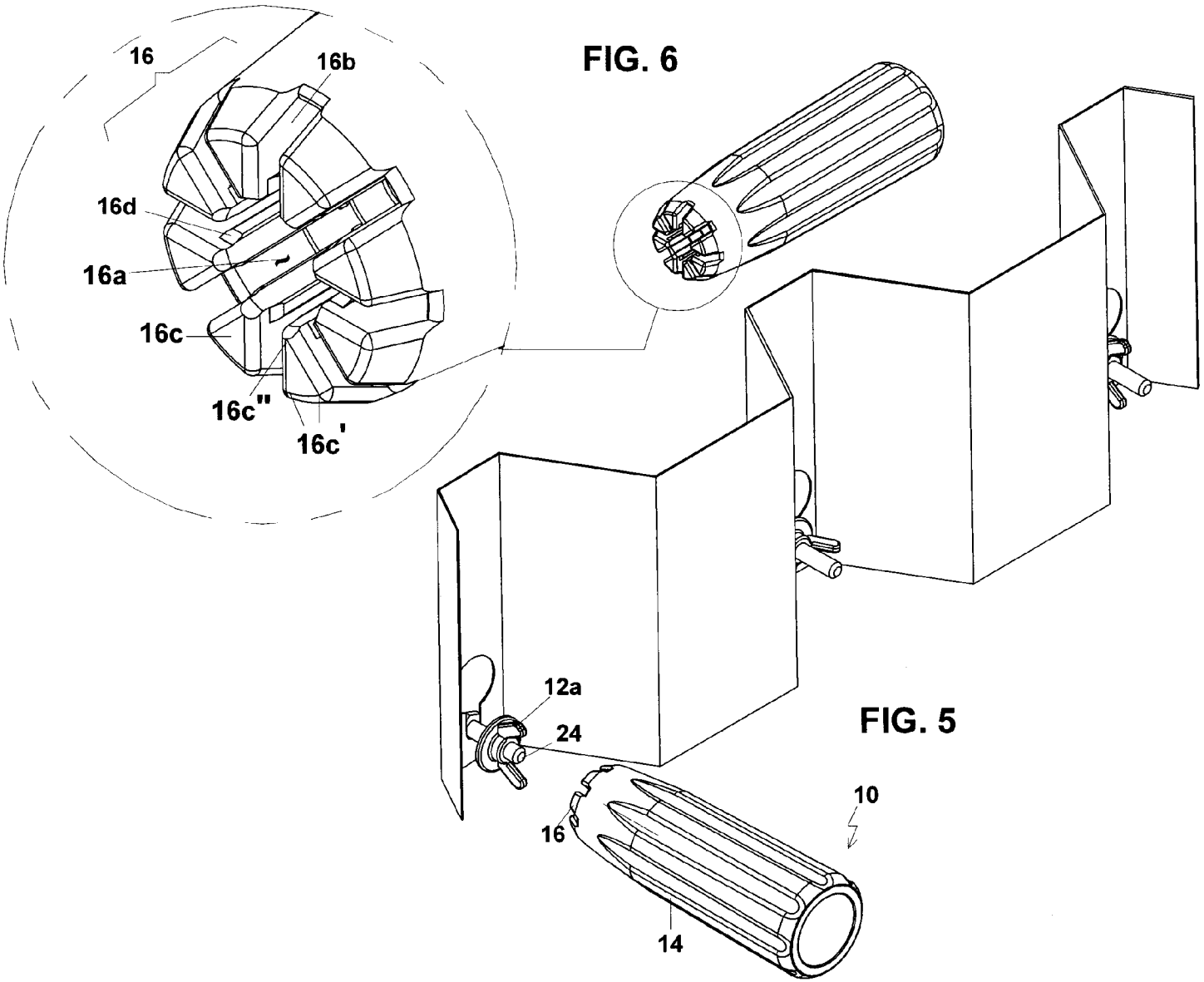
FIG. 5 shows the tool aligned with a wing nut and stud to install a storm shutter panel.
FIG. 6 shows a detailed perspective view of the wing nut engagement surface of the tool.

FIGS. 1A and 1B illustrate a lightweight, ergonomic tool 10 for tightening and installing as well as loosening and removing wing nuts 12. The tool 10 comprises a handle body 14 and at least one wing nut engagement surface 16. The tool 10 is preferably a unitary, single-piece instrument where the wing nut engagement surface 16 is part of the handle body 14. Alternatively, the wing nut engagement surface 16 may be constructed as a separate component that is attached or connected to one end of the handle body 14. The tool 10 is particularly useful for installing and removing wing nuts 12 used to secure storm shutter panels over windows and doors as shown in FIG. 5.

Figure 2:
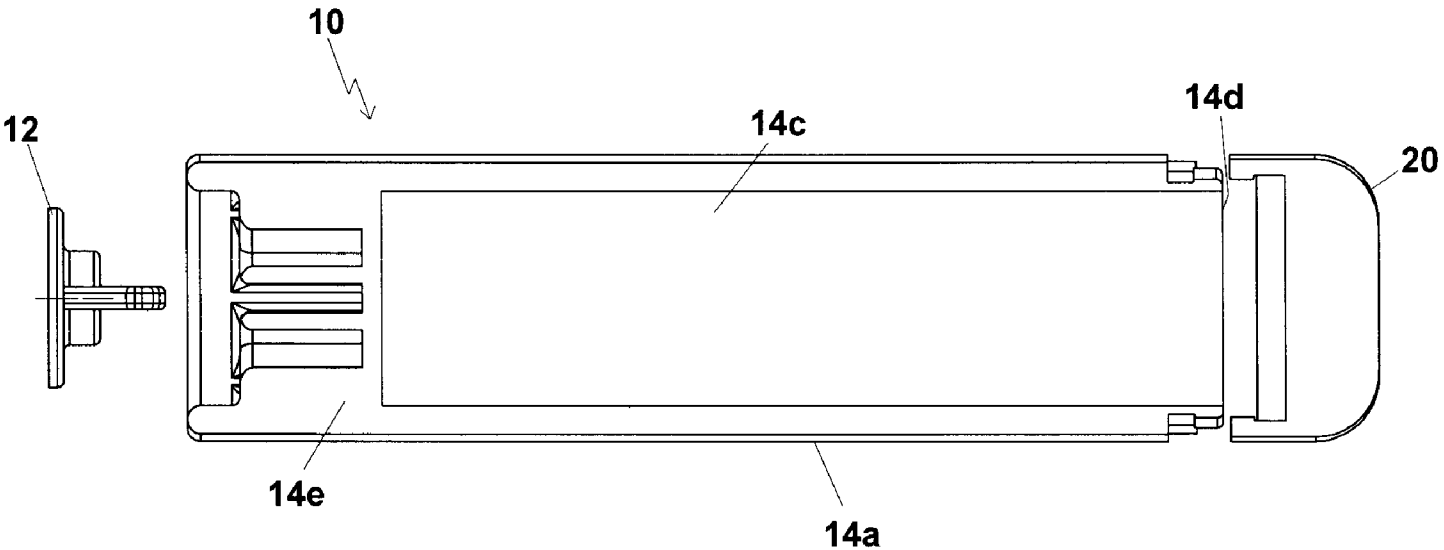
FIG. 2 shows a side elevational view of the tool in cross-section aligned with a wing nut.
Figures 3A, 3B:
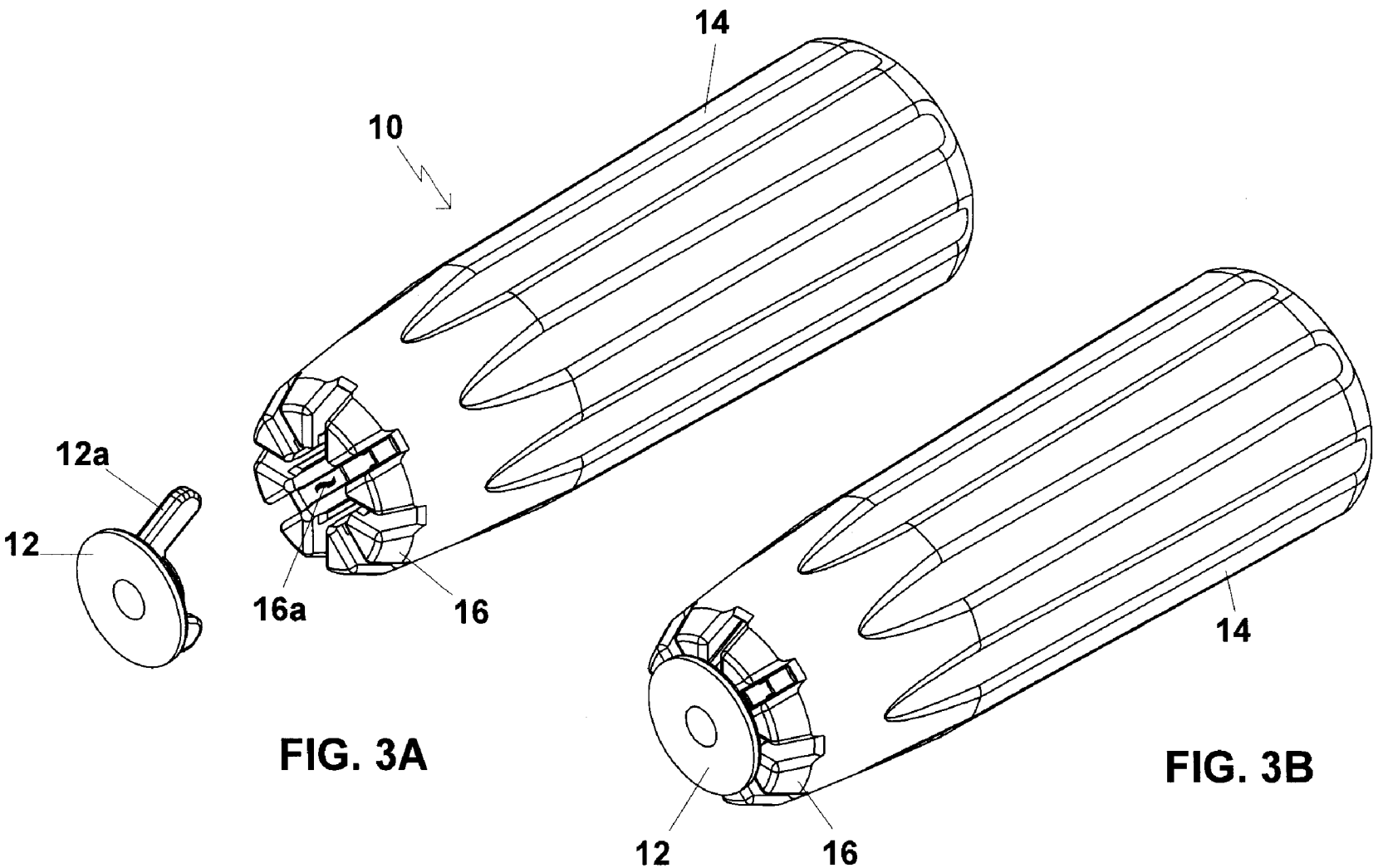
FIG. 3A shows the tool aligned with a wing nut.
FIG. 3B shows the tool engaging a wing nut.

As illustrated in FIG. 2, the handle body 14 is axial and rigid and includes an outer surface 14*a* that is gripped by a hand of a user. The handle body 14 preferably includes grooves 14*b* (shown in FIGS. 1A and 1B) and a finish that provides the user with easy frictional contact for manual gripping and rotation of the tool 10 to install or remove wing nuts 12. Said grooves 14*b* are preferably longitudinal and extend most, if not the entire, length of the handle body. As shown in FIGS. 2 and 3A, the handle body 14 is preferably hollow so that an aperture 16*a* of the wing nut engagement surface 16 passes permits the stud 24 (shown in FIG. 5) over which the wing nut 12 is fitted to pass through said aperture and into a cavity 14*c* formed in the interior of the handle body. The hollow construction of the handle body 14 allows the tool 10 to engage wing nuts 12 having stud portions 24 of various lengths. In the preferred embodiment, the handle body 14 includes an open end 14*d* and a closed end 14*e* (shown in FIG. 2) to which the wing nut engagement surface is connected or attached. In place of the open end 14*d*, the rigid handle body 14 may be closed on both ends as illustrated in FIGS. 2 and 5. When constructed with two closed ends, the end opposite the closed end 14*e* having the wing nut engagement surface 16 may include an adapter 18 for interfacing with an electric drill or electric screwdriver to provide additional torque and to mechanically rotate the tool 10 to install or remove wing nuts 12. Preferably, said adapter 18 is either a chuck or a shank.

While the handle body 14 is preferably axial in construction, other more compact designs are also contemplated, such as an ergonomic handle body shaped as a compact grip that is complementary in shape to the user's palm and fingers. The handle body 14 may be cylindrical in shape and design and tapered on one or both ends. The handle body 14 may also be spherical or mostly spherical in shape or shaped as a horizontal ergonomic bar with alternating converging and diverging sections to comfortably accommodate the hand and fingers of the user.

Figure 4:
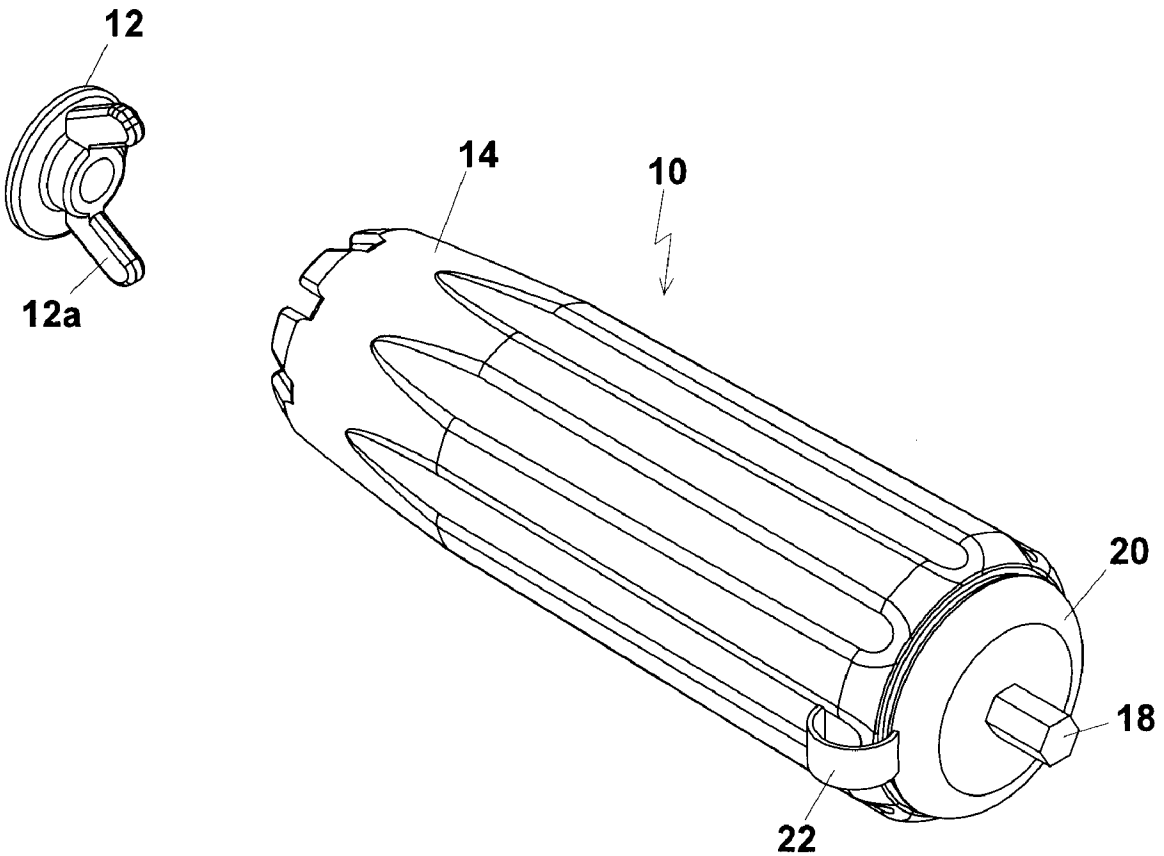
FIG. 4 shows an embodiment of the tool having a hinged cap and a hexagonal chuck adapter for connecting the tool to an electric power tool.

As shown in FIG. 2, the rigid handle body 14 may be open at one end (preferably the open end 14*d* that is opposite said closed end 14*e* having the wing nut engagement surface 16) and includes the hollow cavity 14*c* for holding hardware or other objects sized and shaped to be accommodated within said hollow cavity. The hollow cavity 14*c* of the handle body 14 contributes to the lightweight nature of the tool 10. In this embodiment, the handle body 14 of said tool 10 must include a threaded cap or snap-fit cap 20 for securely covering the open end of the rigid handle body so as to retain any objects placed within the hollow cavity 14*c* of said handle body. Preferably, the cap is a snap-fit cap as shown in FIG. 2. Where a snap-fit cap is used, the cap 20 may be attached to the rigid handle body 14 by a hinge 22 (shown in FIG. 4). The cap 20 may be constructed to include the adapter 18 for interfacing with an electric drill or electric screwdriver to provide additional torque and to mechanically rotate the tool to install or remove wing nuts 12. In FIG. 4, a shank 18 has been chosen to illustrate the adapter 18 which is fixedly attached to the cap 20.

Figure 7B:
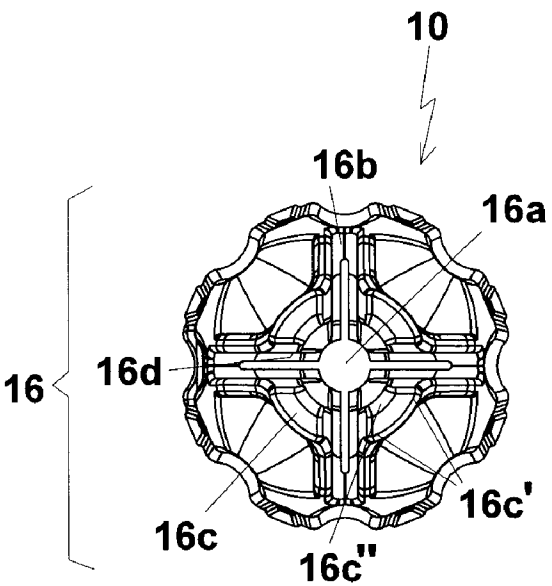
FIG. 7B shows a front elevational view of the preferred embodiment of the tool.

The wing nut engagement surface 16 of the tool 10 is attached at or formed from the closed end 14*e* of the rigid handle body 14 and comprises an aperture 16*a* and one or more slots 16*b* that form a plurality of semi-rigid, flexible engaging projections 16*c* annularly oriented around the aperture as shown in FIGS. 2, 3A, and 6. The aperture 16*a* receives an end of a threaded stud 24 over which a wing nut 12 is threaded, as illustrated in FIG. 5, and the slots 16*b* engage the wings 12*a* of the wing nut as shown in FIG. 1B. The flexible engaging projections 16*c* provide for a snug fit between said tool 10 and said wing nut 12 wherein the threaded stud 24 and wing nut are self-centered by and within the wing nut engagement surface 16 of said tool. Said slots 16*b* are centrally disposed across and through the aperture 16*a*. The flexible engaging projections 16*c* allow said tool 10 to accommodate and to securely and snugly engage wing nuts 12 of various sizes and shapes. Said flexible engaging projections 16*c* are preferably triangular in cross-section and most preferably are shaped as isosceles prisms formed by the slots and projecting from the rigid handle body 14. As illustrated in FIGS. 6 and 7B, each projection 16*c* includes two outward-oriented angles 16*c*' and one inner-oriented angle 16*c*". The inner-oriented angle 16*c*" of each flexible engaging projection 16*c* includes two oppositely disposed flanges 16*d* to assist in grasping and securing the wing nut 12 as said tool 10 is used to install or remove said wing nut. The projections 16*c* are constructed to flex radially outward to accommodate the stud portion 24 of larger wing nuts 12.

Figure 7A:
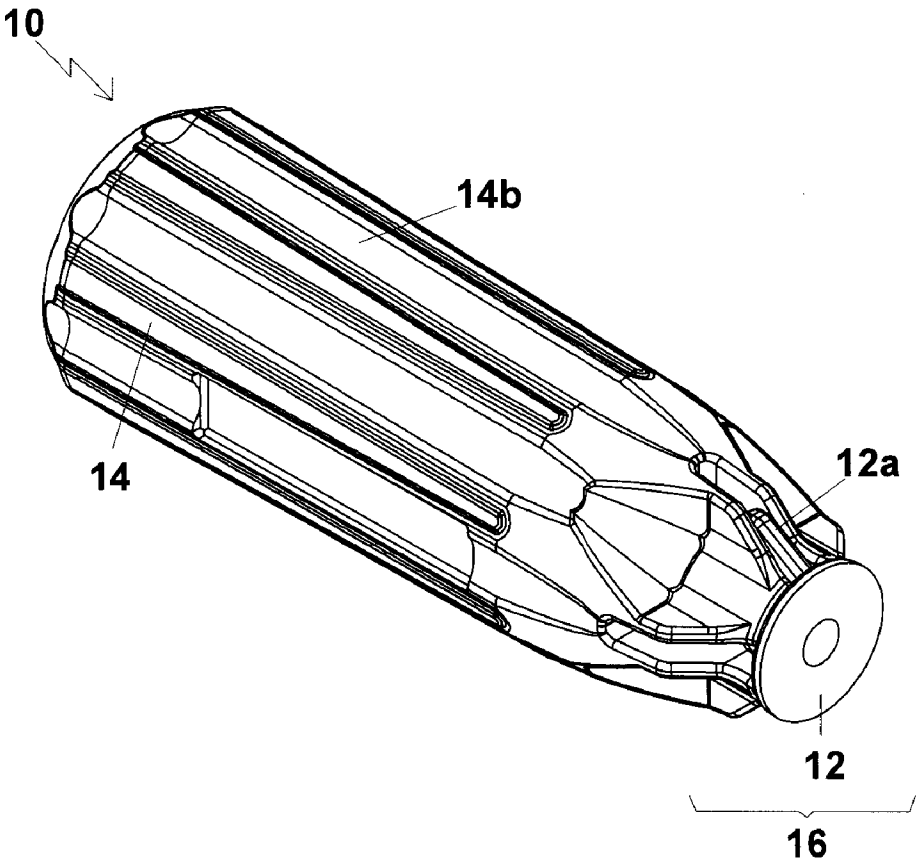
FIG. 7A shows a perspective view of the preferred embodiment of the tool aligned with a wing nut.

FIGS. 7A and 7B illustrate the preferred embodiment of the tool 10, which includes four flexible engaging projections 16*c* arranged around the circumference of the aperture 16*a*. Flanges 16*d* are shown protruding from each side of each projection 16*c* within the slots 16*b*. In this embodiment of the tool, each flexible engaging projection is elongated and includes tapered, buttressed sides as shown in FIGS. 7A and 7B. The stud portion 24 of the wing nut 12 is received by the aperture 16*a* of the wing nut engagement surface 16 of said tool 10.

The tool 10 may be constructed from any durable, rigid material or combination of materials, but is preferably constructed from plastic, metal, or metal alloy. In the most preferred embodiment of the invention, the tool 10 is constructed from injection molded plastic.

As shown in FIGS. 3A and 3B, the tool 10 is aligned with the wing nut 12. The wings 12*a* of the wing nut 12 are received and securely engaged by the slots 16*b* of the wing nut engagement surface 16. The user presses the tool 10 against the wing nut 12 to maintain secure engagement between the tool and the wing nut. As shown in FIG. 5, for installation and removal of wing nuts, the wing nut engagement surface of the tool may be inserted over the wing nut so that the stud portion of said wing nut passes into and is engaged by the aperture while the slots of said engagement surface engage and secure the wings of the wing nut. The wing nut may also be preloaded into the tool prior to installation by aligning and inserting the wings of the wing nut into two or more of the slots and the stud portion of the wing nut into the aperture of the wing nut engagement surface. The tool is manually gripped and rotated in the direction appropriate to either tighten or loosen the wing nut as desired by the user. FIG. 5 illustrates the tool being used to secure wing nuts for installation of a storm shutter panel. In embodiments of the tool including an adapter, said tool may be connected to an electric tool (not shown in the drawings), such as an electric drill or electric screwdriver, to install or remove wing nuts.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A tool for installing and removing wing nuts, comprising:

a rigid handle body including an outer surface that is gripped by a hand of a user;

at least one wing nut engagement surface attached at an end of the rigid handle body, wherein said wing nut engagement feature comprises:

an aperture for receiving an end of a threaded stud over which a wing nut is threaded; and one or more slots centrally disposed across and through the aperture for engaging wings of the wing nut;

wherein said slots separate and form a plurality of engaging projections annularly oriented around the aperture for a snug fit wherein the threaded stud and wing nut are self-centered by said tool;

wherein the engaging projections are flexible and allow said tool to accommodate and securely and snugly engage wing nuts of various sizes and shapes;

wherein the flexible engaging projections are triangular in cross-section;

wherein the flexible engaging projections are shaped as isosceles prisms projecting from the rigid handle body;

wherein each projection includes two outward-oriented angles and one inner-oriented angle; and wherein the inner-oriented angle of each flexible engaging projection includes two oppositely disposed flanges to assist in grasping and securing the wing nut as said tool is used to install or remove said wing nut.

2. The tool of claim 1, wherein said tool is constructed from a durable material or a combination of materials selected from among the following: plastic, metal, and metal alloy.

3. The tool of claim 2, wherein said tool is constructed from injection molded plastic.

4. The tool of claim 1, wherein the rigid handle body includes grooves and a finish that provides the user with easy frictional contact for manual gripping and rotating of the tool to install or remove wing nuts.

5. The tool of claim 1, wherein an end of the handle body opposite said end having the wing nut engagement feature includes an adapter for interfacing with an electric drill or electric screwdriver to provide additional torque and to mechanically rotate the tool to install or remove wing nuts.

6. The tool of claim 5, wherein said adapter is selected from among one of the following: a chuck or a shank.

7. The tool of claim 1, wherein the rigid handle body is open at one end and includes a hollow cavity.

8. The tool of claim 7, wherein said tool includes a cap for securely covering the open end of the rigid handle body so as to retain any hardware or other objects placed within the hollow cavity of said handle body.

9. The tool of claim 8, wherein the cap is attached to the rigid handle body by a hinge.

10. The tool of claim 8, wherein the cap is preferably a snap-fit cap.

11. The tool of claim 7, wherein the cap includes an adapter for interfacing with an electric drill or electric screwdriver to provide additional torque and to mechanically rotate the tool to install or remove wing nuts.

12. The tool of claim 1, wherein the tool is a unitary, single-piece apparatus for tightening and installing as well as loosening and removing wing nuts.

13. The tool of claim 1, wherein the rigid handle body is axial and generally cylindrical in shape.

14. The tool of claim 1, wherein the wing nut engagement surface is capable of receiving a preloaded wing nut for installation.

* * * * *